US008512065B2

(12) United States Patent
Byrne et al.

(10) Patent No.: US 8,512,065 B2
(45) Date of Patent: Aug. 20, 2013

(54) WATERPROOF SIMPLEX RECEPTACLE WITH INSULATION DISPLACEMENT

(76) Inventors: Norman R. Byrne, Ada, MI (US); Matthew Robert Andree, Rockford, MI (US); Randell Ernest Pate, Jenison, MI (US); Timothy John Warwick, Sparta, MI (US)

( * ) Notice: Subject to any disclaimer, the term of this patent is extended or adjusted under 35 U.S.C. 154(b) by 0 days.

(21) Appl. No.: 13/418,106

(22) Filed: Mar. 12, 2012

(65) Prior Publication Data

US 2012/0231652 A1 Sep. 13, 2012

Related U.S. Application Data

(60) Provisional application No. 61/451,902, filed on Mar. 11, 2011, provisional application No. 61/490,970, filed on May 27, 2011.

(51) Int. Cl.
*H01R 4/24* (2006.01)

(52) U.S. Cl.
USPC ..... 439/391; 439/417; 439/685

(58) Field of Classification Search
USPC ..... 439/391–417, 66, 535, 685
See application file for complete search history.

(56) References Cited

U.S. PATENT DOCUMENTS

| | | | | |
|---|---|---|---|---|
| 2,932,000 | A | | 4/1960 | Buchanan |
| 3,611,257 | A | | 10/1971 | Carkhuff |
| 3,850,496 | A | | 11/1974 | Hague |
| 4,245,880 | A | * | 1/1981 | Zimmerman et al. ..... 439/405 |
| 4,372,629 | A | | 2/1983 | Propst et al. |
| 4,747,788 | A | | 5/1988 | Byrne |
| 4,984,982 | A | | 1/1991 | Brownlie et al. |
| 5,234,355 | A | | 8/1993 | Sosiinski et al. |
| 5,485,309 | A | | 1/1996 | Baranetz et al. |
| 5,575,668 | A | | 11/1996 | Timmerman |
| 5,647,751 | A | | 7/1997 | Shulman et al. |
| 5,709,156 | A | | 1/1998 | Gevaert et al. |
| 6,290,512 | B1 | | 9/2001 | Mullen, Jr. |
| 6,309,248 | B1 | | 10/2001 | King |
| 6,454,612 | B1 | | 9/2002 | Wang |
| 6,644,987 | B2 | | 11/2003 | Meleck |
| 6,669,491 | B2 | | 12/2003 | Yoji |
| 7,244,128 | B2 | | 7/2007 | Byrne |
| 7,258,564 | B1 | | 8/2007 | Su |
| 7,833,037 | B2 | | 11/2010 | Reusche et al. |
| 2010/0317206 | A1 | | 12/2010 | Byrne |
| 2011/0244700 | A1 | | 10/2011 | Byrne |

* cited by examiner

*Primary Examiner* — Briggitte R Hammond
(74) *Attorney, Agent, or Firm* — Gardner, Linn, Burkhart & Flory, LLP

(57) ABSTRACT

A receptacle comprises a simplex body with a front portion and terminals. A rear housing encloses female connectors and a ground connector, which are attached to corresponding terminals. Insulation displacers comprise conductive elements that cut through insulation on each side of power-supply wires. Features of both waterproofing and insulation displacement are therefore combined.

17 Claims, 5 Drawing Sheets

WATERPROOF SIMPLEX RECEPTACLE WITH INSULATION DISPLACEMENT

CROSS-REFERENCE TO RELATED APPLICATIONS

This application claims priority of U.S. Provisional Patent Application Ser. No. 61/490,970 filed May 27, 2011, and U.S. Provisional Patent Application Ser. No. 61/451,902 filed Mar. 11, 2011.

STATEMENT REGARDING FEDERALLY SPONSORED RESEARCH OR DEVELOPMENT

Not applicable.

REFERENCE TO A MICROFISHE APPENDIX

Not applicable.

BACKGROUND OF THE INVENTION

1. Field of the Invention

The invention relates to electrical systems and, more particularly, to electrical receptacles mounted in configurations where they may be susceptible to water or other liquid damage or danger.

2. Background Art

The use of computers, telecommunications equipment and other electronic devices is continuing to rapidly increase in office, commercial, industrial and other environments. As a result, the importance of efficiently supplying power throughout these environments is also increasing. Historically, one problem with use of electrical power is the positioning of electrical power outlet ports, such as electrical receptacles. Positioning of these devices is important with respect to both convenience and cost efficiency. Electrical receptacles for supplying power to various types of devices (lighting, computers, etc) must be located in accessible positions for all types of use.

In this regard, it is known to employ electrical receptacles directly mounted to various types of furniture, such as bookshelves and desks. These receptacles may be mounted at a location substantially above a floor surface, and allow the user to interconnect electrical devices near their locations of use, thereby avoiding the necessity of running device cords and cables a substantial distance.

A system employing covered receptacles mounted within a workstation is disclosed in Propst, U.S. Pat. No. 4,372,629 issued Feb. 8, 1993. The Propst arrangement includes a desk top having a rear cover hinged to a vertical back panel. Receptacles are mounted to the lower portion of the cover and bristles extend horizontally from the cover to an edge of the desktop when the cover is closed. When the cover is opened, the user can "plug in" the cord of a desired electrical device and close the cover, with the cord then extending through the bristles.

A further advance of the prior art was achieved with the commonly owned Byrne, U.S. Pat. No. 4,747,788 issued May 31, 1988. In this patent, a retractable power center is disclosed which is manually operable. The power center includes a movable and vertically slidable power carriage utilized to mount electrical receptacles. The carriage can be extended between an open position and a closed, retracted position.

In Brownlie, et al., U.S. Pat. No. 4,984,982 issued Jan. 15, 1991 an access flooring module is provided, which is mounted in an opening provided in a floor. The module is moveable between open and closed positions, so as to receive electrical components such as power sockets.

Timmerman, U.S. Pat. No. 5,575,668, issued Nov. 19, 1996 discloses a temporary power/data tap for delivery electrical power and data service to a work surface from a distant standard wall or floor mounted electrical receptacle. Another device comprising utility receptacles and specifically directed to use in a work surface is disclosed in Gevaert, et al., U.S. Pat. No. 5,709,156 issued Jan. 20, 1998.

In accordance with the foregoing, various types of configurations exist with respect to mounting electrical receptacles. However, one problem with a number of known electrical receptacles relates to the potential damage (or dangerous situations) from environmental conditions. For example, electrical receptacles may be constructed and configured in such a way as to be susceptible to damage from water or other fluids. As well known in the electrical industry, water spillage or the like may result not only in damage to electrical components, but may also cause dangerous situations, due to electrical arcing or similar electrical malfunctions caused by water spillage and seepage.

SUMMARY OF THE INVENTION

In accordance with the invention, an electrical receptacle assembly includes at least one receptacle comprising a main receptacle body. The assembly includes a series of terminals for receiving an electrical plug of a device to be energized. A series of wire or cables, numbering the same as the number of electrical terminals, are adapted to provide electrical power when the wires or cables are electrically coupled to the main receptacle body.

A rear housing forms an enclosure adapted to be secured to the main receptacle body, with the rear housing having means to receive the electrical wires or cables. A waterproofing clip having a resilient configuration is adapted to be fitted around the rear housing and coupled to the main receptacle body so as to secure the housing to the body. A series of connectors, numbering the same as the number of electrical terminals associated with the main receptacle body, are provided with an insulation displacer on an end of each connector for connection to a corresponding one of the electrical wires. The insulation displacers comprise conductive elements for cutting through the insulation on each of the wires, so as to cause contact with the conductive elements of the wires.

The conductive elements of the insulation displacers can comprise clips of relatively sharp prongs or contact edges which automatically strip insulation from individual ones of the electrical wires as desired points of contact. The electrical terminals include a ground terminal, neutral terminal and hot terminal. A rear portion of a simplex body of the receptacle assembly at least partially encloses a pair of female connectors and a ground connector attached to the neutral, hot and ground terminals, respectively.

A first wire positioning box element is placed rearwardly of a rear housing, with the insulation displacers extending therethrough. The first wire positioning box element includes grooves along one edge thereof, so as to facilitate placement of the wires. The wires are placed in the grooves and inserted between the conductive elements of displacers, such that the conductive elements of the displacers are in contact with the conductive elements of the wires. A second wire positioning box element is put into place so as to protect the insulation displacer and the wiring. The wiring can be in the form of either bear or stranded wiring. The insulation displacement eliminates the need for butt splices and significantly reduces the relative amount of copper wiring needed for connection to receptacle assembly.

BRIEF DESCRIPTION OF THE SEVERAL VIEWS OF THE DRAWING

The invention will now be described with reference to the drawings, in which.

DETAILED DESCRIPTION OF THE INVENTION

Figure 4:
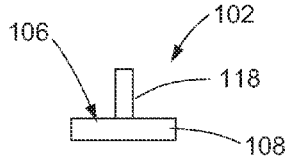
Fig. 4 (Prior Art)
FIG. 4 is a plan view of the simplex receptacle body shown in FIG. 1.
Figure 3:
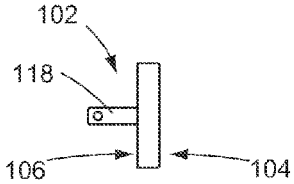
Fig. 3 (Prior Art)
FIG. 3 is a left-side view of the simplex receptacle body shown in FIG. 1.
Figure 1:
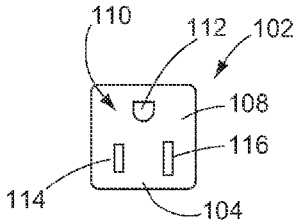
Fig. 1 (Prior Art)
FIG. 1 is an elevation view of a known simplex receptacle body.
Figure 2:
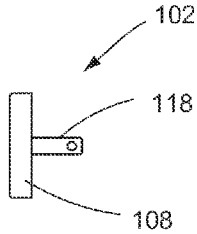
Fig. 2 (Prior Art)
FIG. 2 is a right-side view of the simplex receptacle body shown in FIG. 1.
Figure 5:
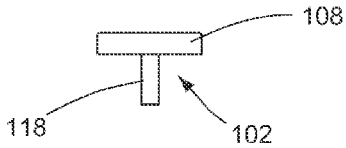
Fig. 5 (Prior Art)
FIG. 5 is an underside view of the simplex receptacle body shown in FIG. 1.

The principles of the invention are disclosed, by way of example, in a number of embodiments of waterproof simplex receptacles having structure and features directed to water-shedding. These embodiments are illustrated in FIGS. 17-29. For purposes of understanding general principles of waterproof simplex receptacles, a waterproof simplex receptacle 100 will first be described with respect to FIGS. 1-16. This particular simplex receptacle 100 is disclosed in commonly owned Byrne U.S. Pat. No. 7,244,128 issued Jul. 17, 2007. Following the descriptions of simplex receptacle 100, the embodiments of the simplex receptacle in accordance with the invention will be described.

The waterproof simplex receptacle includes a receptacle body having electrical wires or cables interconnected thereto. A rear housing is formed around the rear portion of the receptacle body, and substantially encloses the electrical wires or cables. For purposes of providing waterproof properties, a waterproofing clip is appropriately sized and configured so as to fit around portions of the rear housing, in a manner so as to "block" any openings and prevent any water seepage into the rear housing.

Turning to the drawings, FIGS. 1-5 illustrate, standing alone, a simplex receptacle body 102 in accordance with the invention. With specific reference to FIGS. 1-5, the receptacle body 102 includes a front portion 108 having a substantially square or otherwise rectangular configuration. The front portion 108 includes a front surface 104 and a rear surface 106. Extending through the front portion 108 are a series of three terminals 110. In the particular embodiment disclosed herein, the terminals include a ground terminal 112, neutral terminal 114 and hot terminal 116. These terminals are conventional in nature and well known in the prior art. Further, it should be emphasized that various other electrical terminal configurations can be utilized for a simplex receptacle in accordance with the invention, without departing from the basic novel concepts of the invention.

The simplex receptacle body 102 also includes a connecting mount 118, comprising an elongated element extending rearwardly from the rear surface 106 of the front portion 108. The connecting mount 118 can be utilized for appropriately securing various elements of the waterproof simplex receptacle 100.

Figures 6, 7, 8, 9, 10, 11, 12:
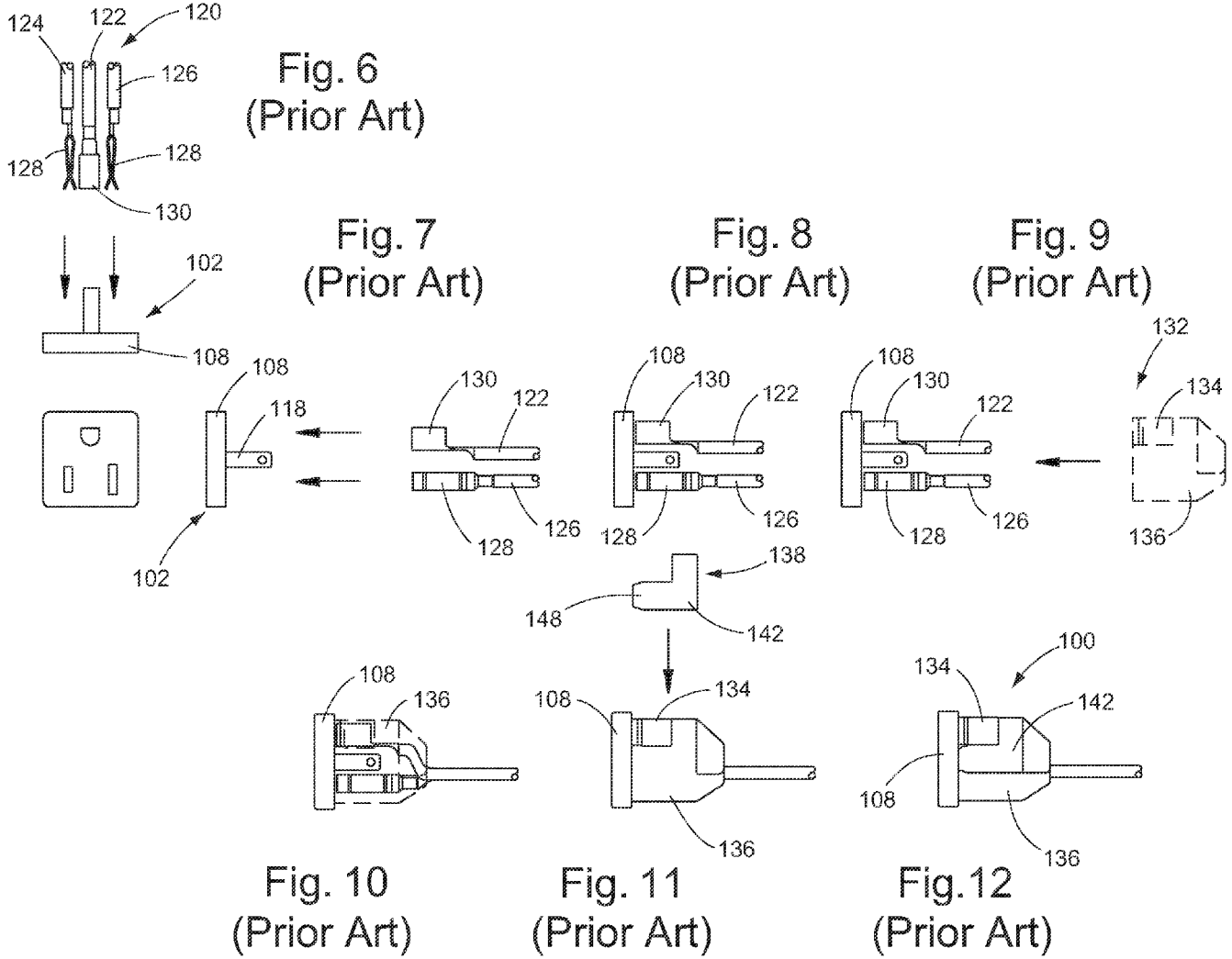
Fig. 6 (Prior Art)
Fig. 7 (Prior Art)
Fig. 8 (Prior Art)
Fig. 9 (Prior Art)
Fig. 10 (Prior Art)
Fig. 11 (Prior Art)
Fig. 12 (Prior Art)
FIG. 6 is a partially exploded and plan view showing the relative positioning of the simplex receptacle body and electrical wires or cables to be connected to the simplex receptacle bodies.
FIG. 7 is a right-side view of the simplex receptacle body and the electrical wires or cables shown in FIG. 6.
FIG. 8 is a right-side view similar to FIG. 7, but showing the electrical wires or cables in an interconnected configuration with the simplex receptacle body.
FIG. 9 is a right-side view showing the interconnected electrical wires or cables and the simplex receptacle body, and further showing a sectional side view of the rear housing to be mounted to the simplex receptacle body.
FIG. 10 is a right-side elevation view similar to FIG. 9, but showing the sectional view of the rear housing as it is positioned when coupled to the simplex receptacle body.
FIG. 11 is a partially exploded and right side view showing the interconnected simplex receptacle body, electrical wires or cables, rear housing and the waterproofing clip positioned so as to be interconnected to the rear housing.
FIG. 12 is a right-side elevation view similar to FIG. 11, but showing the waterproofing clip in its interconnected position.
Figure 13:
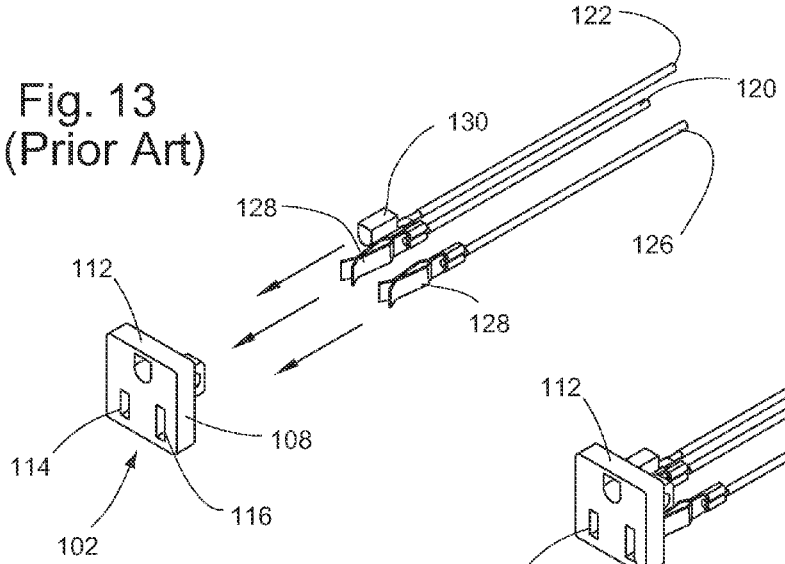
Fig. 13 (Prior Art)
FIG. 13 is a perspective and partially exploded view, somewhat similar to FIG. 7, in that it shows the positioning of the electrical wires or cables as they are being interconnected to the simplex receptacle body.
Figure 14:
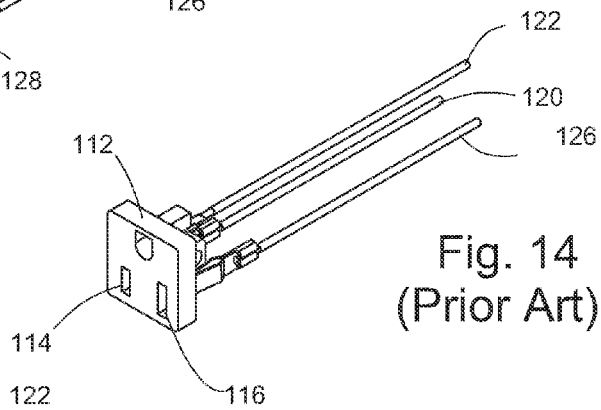
Fig. 14 (Prior Art)
FIG. 14 is a perspective view similar to FIG. 13, but showing the electrical wires or cables interconnected to the simplex receptacle body.

With reference now to FIGS. 6-9, 13 and 14, the waterproof simplex receptacle 100 is adapted to be utilized with a set of electrical wires or cables 120. As shown, for example, in FIGS. 6 and 13, the electrical wires or cables 120 comprise three wires or cables. These three wires or cables 120 further comprise a ground wire 122, neutral wire 124 and hot wire 126. These wires are conventional in nature and may be separate wires, conduit or other type of cabling. Connected at the end of the ground wire 122 is a conventional ground connector 130. Connected to the ends of each of the neutral wire 124 and hot wire 126 is a female connector 128. Again, these connectors are conventional in nature. The ground connector 130 may be connected in any conventional manner to the ground terminal 112 of the simplex receptacle body 102. Correspondingly, the female connector 128 associated with the neutral wire 124 may be electrically connected to the neutral terminal 114 of the receptacle body 102. Still further, the female connector 128 associated with the hot wire 126 may be electrically connected in a conventional manner to the hot terminal 116 of the receptacle body 102. This interconnection is shown in FIGS. 8 and 14.

The waterproof simplex receptacle 100 in accordance with the invention further includes what is characterized as a rear housing 132. The rear housing 132 is shown in FIGS. 9, 10, 11, 12, 15 and 16. With reference to these drawings, the rear housing 132 has a shape and configuration whereby it can be secured to the rear surface 106 of the simplex receptacle body 102, in a manner so as to substantially enclose the electrical wires or cables 120. With reference to the drawings, the rear housing 132 includes an upper box-like structure 134. The upper box structure 134 extends lengthwise across the top of the rear surface 106 of the simplex receptacle body 102. Below the upper box 134 is a main housing body 136. The main housing body 136 has a substantially box-like configuration, and substantially encloses the female connectors 128 associated with the neutral and hot wires 124, 126 respectively. As shown in FIG. 9, the rear housing 132 is inserted as part of the simplex receptacle 100 through the electrical wires or cables 120, and connected by any conventional means to the rear surface 106 of the receptacle body 102.

Figure 15:
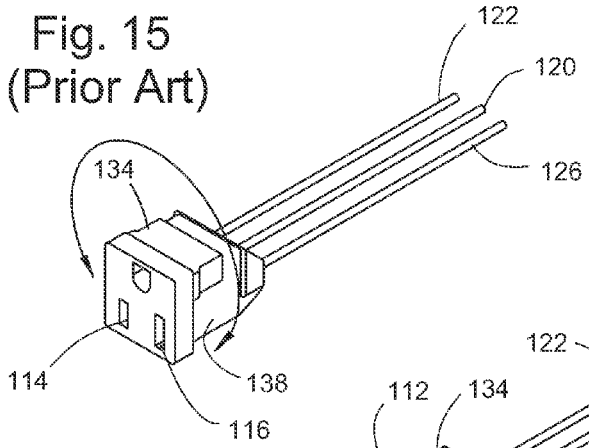
Fig. 15 (Prior Art)
FIG. 15 is similar to FIG. 11, but shows, in perspective view, the interconnected simplex receptacle body, rear housing, electrical wires or cables, and the waterproofing clip in a position to be connected.
Figure 16:
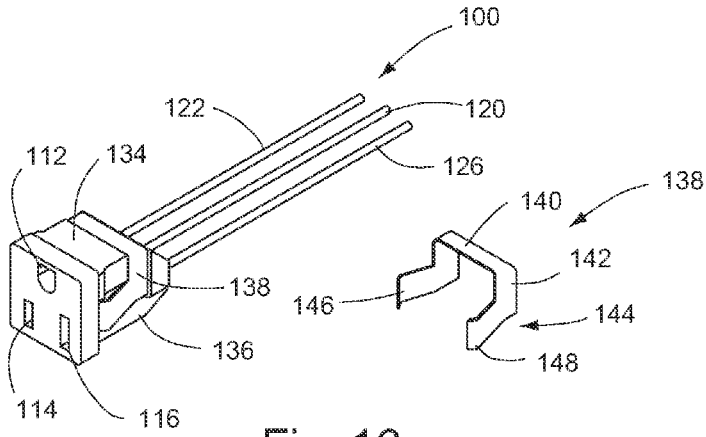
Fig. 16 (Prior Art)
FIG. 16 is similar to FIG. 12, but shows the entire interconnection of the waterproof simplex receptacle, in perspective view.

The waterproof simplex receptacle 100 also includes a waterproofing clip 138. The waterproofing clip 138 is primarily shown in FIGS. 11, 12, 15 and 16. In particular, a perspective view of the waterproofing clip 138 is illustrated in FIG. 15. As shown therein, the waterproofing clip 138 includes an upper portion 140 extending lengthwise across the clip 138. A pair of vertical connecting portions 142 extend downwardly from opposing ends of the upper portion 140. At the lower ends of the vertical connecting portions 142, spring legs 144 extend forwardly from each of the vertical connecting portions 142. These elements of the waterproofing clip 138 may be separate and interconnected, or may preferably be constructed integral with each other. In particular, the spring clips 144 may be resilient in nature and sized so as to be "snap fitted" around the main housing body 136 of the rear housing 132. The spring legs 144 comprise a left leg 146 and right leg 148. As previously stated, the legs 144 are resilient in nature, so as to appropriately snap fit on the rear housing 132, thereby appropriately securing all elements for the waterproof simplex receptacle 100. With the rear housing 132 and the waterproofing clip 138, the rear portion of the simplex receptacle 100 is essentially waterproof, and will resist any seepage of water or other liquids therein.

It should be emphasized that other configurations of the waterproof simplex may be utilized. Also, the concepts associated with the waterproof simplex may be applied to other types of receptacle configurations, such as duplex receptacles. As earlier mentioned, various types of electrical wires or cables may be utilized, and the simplex receptacle may have various terminal configurations, such as the absence of a ground terminal or the like. Still further, it is apparent that one of the advantages of waterproof simplex receptacles in accordance with the invention is that the rear housing and waterproofing clip may be "retrofitted" to existing simplex receptacles. Also, the concepts associated with the waterproof simplex receptacle 100 are not limited with respect to any particular sizes or dimensions of receptacles.

The principles of the invention, which allow for the waterproof properties of the simplex receptacle to be retained while also providing for a more efficient method of attaching wiring thereto, will now be described with respect to an embodiment of a waterproof simplex receptacle 200. This embodiment of the simplex receptacle is illustrated in FIGS. 17-29. Like or analogous parts in simplex receptacle 200 will be labeled to correspond with similar or analogous structures in simplex receptacle 100.

Figure 17:
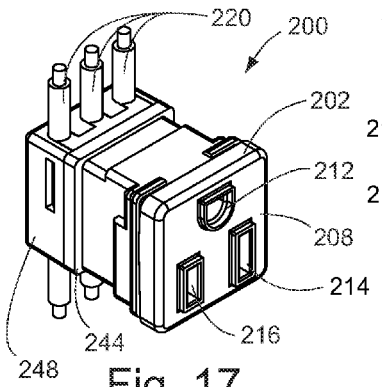
FIG. 17 is a front perspective view of a waterproof simplex receptacle with insulation displacement connections in accordance with the present invention.
Figure 25:
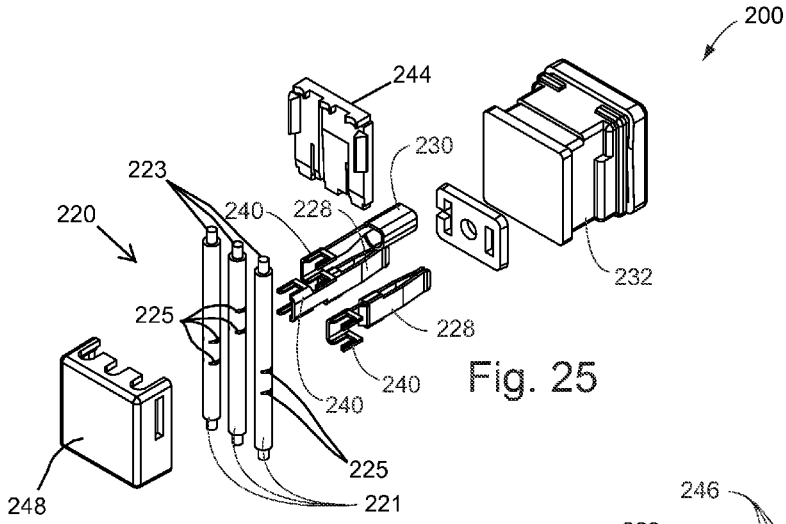
FIG. 25 is a partially exploded rear perspective view of the waterproof simplex receptacle with insulation displacement connections.
Figure 26:
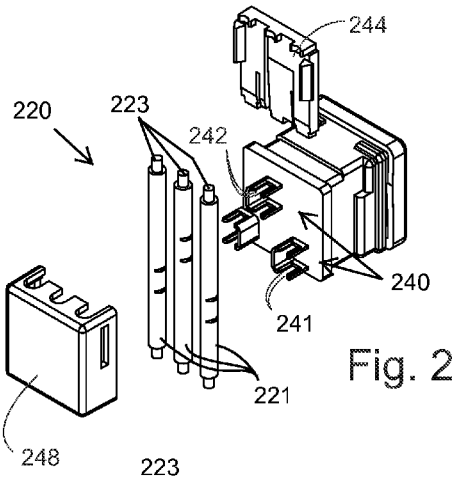
FIG. 26 is a partially exploded rear perspective view of the waterproof simplex receptacle with insulation displacement connections, showing the installation of the terminal clips to the simplex receptacle.
Figure 27:
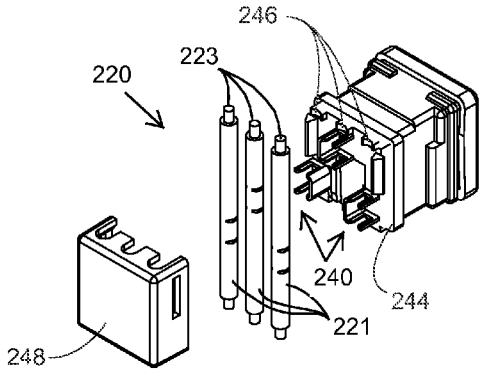
FIG. 27 is a partially exploded rear perspective view of the waterproof simplex receptacle with insulation displacement connections, showing the attachment of the first portion of the wire locating box.

Receptacle 200 comprises a simplex body 202 with a front portion 208 (FIG. 17). A plurality of terminal openings extend through front surface 208, including a ground terminal opening 212, a neutral terminal opening 214, and a hot terminal opening 216. At the rear of the simplex body 202 is a rear housing 232 which substantially at least in part encloses female terminals 228 that are disposed in the neutral and hot terminal openings 214, 216, and a ground terminal 230 that is disposed in the ground terminal opening (FIG. 25). Rear housing 232 comprises a window slot 233 (FIG. 20) where simplex receptacle 200 fits through a cutout or wall element. A molded element 235 is provided around the circumference of the rear housing 232, to define the rear of window slot 233 FIGS. (19-24).

Figure 18:
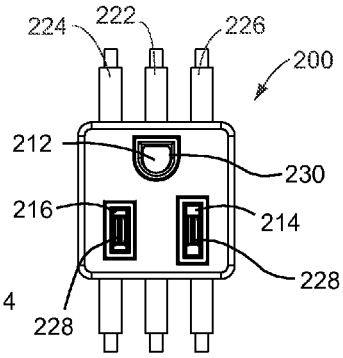
FIG. 18 is a front elevation view of the waterproof simplex receptacle with insulation displacement connections.
Figure 19:
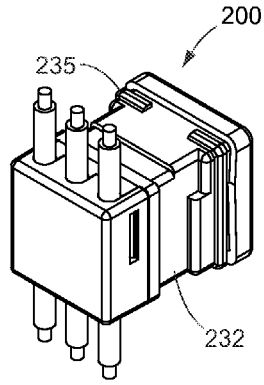
FIG. 19 is a rear perspective view of the waterproof simplex receptacle with insulation displacement connections.
Figure 20:
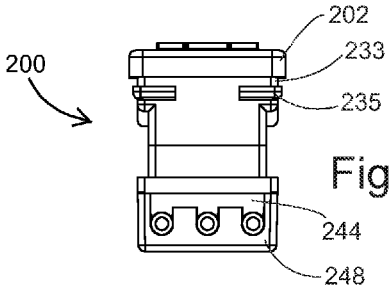
FIG. 20 is a top plan view of the waterproof simplex receptacle with insulation displacement connections.
Figure 21:
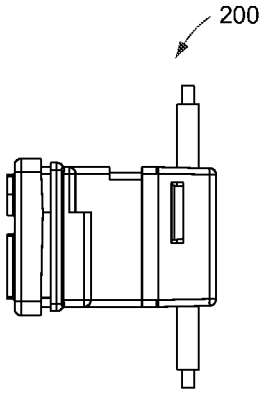
FIG. 21 is a left side elevation view of the waterproof simplex receptacle with insulation displacement connections.
Figure 22:
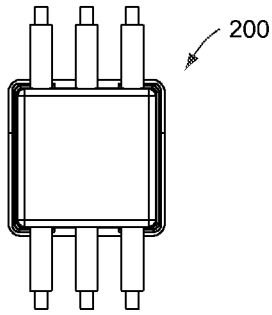
FIG. 22 is a rear elevation view of the waterproof simplex receptacle with insulation displacement connections.
Figure 23:
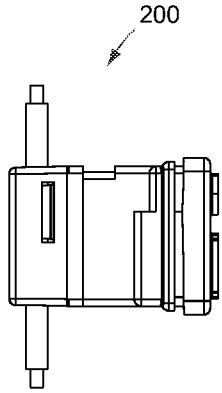
FIG. 23 is a right side elevation view of the waterproof simplex receptacle with insulation displacement connections.
Figure 24:
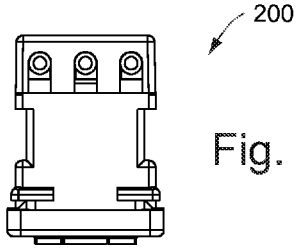
FIG. 24 is a bottom plan view of the waterproof simplex receptacle with insulation displacement connections.

Female terminals 228 and ground terminal 230 are each provided with insulation displacers 240 on the rear ends thereof (FIGS. 25-28) for connection to insulated power supply wires 220, including a ground wire 222, neutral wire 224 and hot wire 226 (FIG. 18). Insulation displacers 240 comprise conductive elements 242 (FIG. 26) configured to cut through insulation 221 on each side of wires 220, such as shown in FIGS. 25-28, and to thereby electrically contact the electrical conductors 223 of the respective wires 220.

Conductive elements 242 comprise clips with relatively sharp prongs or contact edges 241 (FIG. 26) which automatically cut or strip the insulation 221 from a respective insulated wire 220 at the point or points of contact 225 (FIGS. 25-28). This function of insulation displacement therefore results in a direct, electrical conductive contact between the terminals 228, 230 and the electrical conductors 223 of the wires 220.

Figure 28:
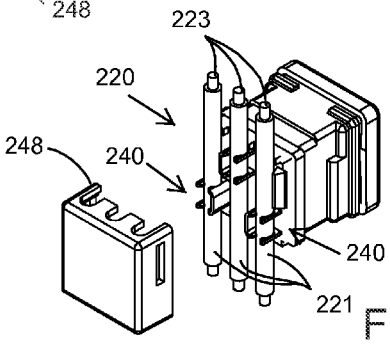
FIG. 28 is a partially exploded rear perspective view of the waterproof simplex receptacle with insulation displacement connections, showing the placement of wires on the insulation displacement elements.
Figure 29:
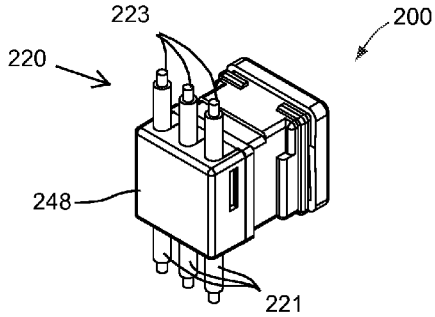
FIG. 29 is a rear perspective view of the waterproof simplex receptacle with insulation displacement connections, showing the attachment of the second portion of the wire locating box.

A first wire positioning box element 244 is placed rearwardly of the rear housing 232, with insulation displacers 240 extending therethrough (FIGS. 26-28), with the first wire positioning box element 244 having grooves 246 along one edge thereof (FIG. 27), to facilitate placement of wires 220, such as shown in FIG. 28. Then, wires 220 are placed along grooves 246 and are inserted between conductive elements 242 of the insulation displacers 240 (FIGS. 27 and 28), such that the conductive elements 242 of insulation displacers are in contact with the electrical conductors 223 of wires 220, and a second wire positioning box element 248 is put into place to protect insulation displacers 240 and wiring 220.

Using the insulation displacement connection principle as described herein would retain the waterproof feature of the simplex receptacle and housing. The insulation displacement connection could also be used with either bare or stranded wiring. The insulation displacement further eliminates the need for butt splices and greatly reduces the amount of copper wiring needed for connection to the receptacle 200.

It will be apparent to those skilled in the pertinent arts that other embodiments of the invention can be designed. That is, the principles of the invention are not limited to the specific embodiments described herein. Accordingly, it will be apparent to those skilled in the art that modifications and other variations of the above-described illustrative embodiments of the invention may be effected without departing from the spirit and scope of the novel concepts of the invention.

What is claimed is:

1. An electrical receptacle assembly comprising:

a receptacle body defining a plurality of terminal openings for receiving an electrical plug of an electrical device;

a plurality of electrical terminals disposed in respective ones of said terminal openings in said receptacle body;

a plurality of insulation displacers in electrical communication with respective ones of said electrical terminals, said insulation displacers protruding from said receptacle body and each comprising a conductive element;

a first wire positioning element at a rearward end portion of said receptacle body, with said insulation displacers extending therethrough, said first wire positioning element defining a plurality of grooves configured to engage and maintain alignment of the electrical wires;

a second wire positioning element configured to couple to said first wire positioning element with the electrical wires disposed and substantially secured between said first and second wire positioning elements when said insulation displacers engage said electrical wires, to thereby protect said insulation displacers and said electrical wires; and wherein said insulation displacers are configured to cut through and displace any insulation material surrounding electrical conductors of electrical wires when said wires are biased into engagement with said insulation displacers, whereby said conductive elements of said insulation displacers establish electrical connections between the electrical conductors of the electrical wires and respective ones of said electrical terminals.

2. The electrical receptacle assembly of claim 1, wherein said electrical terminals comprise a ground terminal, a neutral terminal, and a hot terminal.

3. The electrical receptacle assembly of claim 1, wherein said conductive elements of said insulation displacers comprise sharp contact edges.

4. The electrical receptacle assembly of claim 3, wherein said conductive elements each comprise at least two of said sharp contact edges for engaging opposite sides of the electrical wires.

5. The electrical receptacle assembly of claim 1, further in combination with the electrical wires, wherein said electrical wires comprise at least one chosen from (i) insulated single-conductor wiring, (ii) insulated multi-conductor wiring, and (iii) non-insulated wiring.

6. The electrical receptacle assembly of claim 5, wherein said electrical wires are held in substantially parallel alignment by said insulation displacers.

7. The electrical receptacle assembly of claim 1, wherein said insulation displacers and said electrical terminals are unitarily formed.

8. The electrical receptacle assembly of claim 7, wherein said insulation displacers protrude from a rear surface of said receptacle body.

9. An electrical receptacle assembly comprising:

a receptacle body defining a plurality of terminal openings for receiving an electrical plug of an electrical device;

a plurality of electrical terminals disposed in respective ones of said terminal openings in said receptacle body;

a plurality of insulation displacers in electrical communication with respective ones of said electrical terminals, said insulation displacers protruding from said receptacle body and each comprising a conductive element having at least one sharp contact edge;

a first wire positioning element at a rearward end portion of said receptacle body, with said insulation displacers extending therethrough, said first wire positioning element defining a plurality of grooves configured to engage and maintain alignment of the electrical wires;

wherein said insulation displacers are configured to cut through and displace any insulation material surrounding electrical conductors of electrical wires when said wires are biased into engagement with said insulation displacers, whereby said conductive elements of said insulation displacers establish electrical connections between the electrical conductors of the electrical wires and respective ones of said electrical terminals; and a second wire positioning element configured to couple to said first wire positioning element with the electrical wires disposed and substantially secured between said first and second wire positioning elements when said insulation displacers engage said electrical wires, to thereby protect said insulation displacers and said electrical wires.

10. The electrical receptacle assembly of claim 9, wherein said electrical terminals comprise a ground terminal, a neutral terminal, and a hot terminal.

11. The electrical receptacle assembly of claim 9, wherein said conductive elements each comprise at least two of said sharp contact edges for engaging opposite sides of the electrical wires.

12. The electrical receptacle assembly of claim 11, wherein said conductive elements each comprise at least four of said sharp contact edges, with at least two of said sharp contact edges engaging each opposite side of the electrical wires.

13. The electrical receptacle assembly of claim 9, further in combination with the electrical wires, wherein said electrical wires comprise at least one chosen from (i) insulated single-conductor wiring, (ii) insulated multi-conductor wiring, and (iii) non-insulated wiring.

14. The electrical receptacle assembly of claim 13, wherein said electrical wires are held in substantially parallel alignment by said insulation displacers.

15. The electrical receptacle assembly of claim 9, wherein said insulation displacers and said electrical terminals are unitarily formed.

16. The electrical receptacle assembly of claim 15, wherein said insulation displacers protrude from a rear surface of said receptacle body.

17. A method of assembling an electrical receptacle, said method comprising:

positioning a plurality of electrical terminals in a respective plurality of terminal openings formed in a receptacle body, wherein the terminal openings are configured for receiving an electrical plug of an electrical device;

positioning a plurality of insulation displacers so that they protrude from the receptacle body, wherein the insulation displacers are in electrical communication with respective ones of the electrical terminals, and include respective conductive elements;

aligning a plurality of electrical wires with respective ones of the insulation displacers by:

positioning a first wire positioning element at a rearward end portion of the receptacle body, with the insulation displacers extending through the first wire positioning element; and positioning the electrical wires along respective grooves formed in the first wire positioning element;

urging the plurality of electrical wires into contact with the insulation displacers;

cutting insulation material of the electrical wires with the insulation displacers while moving the electrical wires along the insulation displacers;

establishing electrical contact between the electrical terminals and electrical conductors of the electrical wires by contacting the electrical conductor with conductive elements of the insulation displacers where the insulation material is cut thereby; and coupling a second wire positioning element to the first wire positioning element so that the electrical wires are engaged by the insulation displacers between the first and second wire positioning elements, and so that the electrical wires are disposed and substantially secured between the first and second wire positioning elements.

* * * * *